US010072557B2

(12) United States Patent
Gullberg et al.

(10) Patent No.: US 10,072,557 B2
(45) Date of Patent: Sep. 11, 2018

(54) HEAT EXCHANGER SYSTEM FOR A VEHICLE

(71) Applicant: VOLVO TRUCK CORPORATION, Göteborg (SE)

(72) Inventors: Peter Gullberg, Göteborg (SE); Andreas Lygner, Åsa (SE); Kaj Melin, Floda (SE)

(73) Assignee: Volvo Truck Corporation, Göteborg (SE)

( * ) Notice: Subject to any disclaimer, the term of this patent is extended or adjusted under 35 U.S.C. 154(b) by 291 days.

(21) Appl. No.: 14/903,512

(22) PCT Filed: Jul. 12, 2013

(86) PCT No.: PCT/SE2013/000114
§ 371 (c)(1),
(2) Date: Jan. 7, 2016

(87) PCT Pub. No.: WO2015/005832
PCT Pub. Date: Jan. 15, 2015

(65) Prior Publication Data
US 2016/0177810 A1 Jun. 23, 2016

(51) Int. Cl.
*F01P 11/10* (2006.01)
*F01P 5/06* (2006.01)
(Continued)

(52) U.S. Cl.
CPC ..... *F01P 11/10* (2013.01); *F01P 1/06* (2013.01); *F01P 5/06* (2013.01); *F04D 17/10* (2013.01);
(Continued)

(58) Field of Classification Search
CPC ..... F01P 1/06; F01P 5/06; F01P 11/10; F04D 17/08; F04D 17/10; F04D 17/16;
(Continued)

(56) References Cited

U.S. PATENT DOCUMENTS 1,149,638 A 8/1915 Davidson
4,086,886 A * 5/1978 Edmaier ..... F01P 3/18 123/41.49
(Continued)

FOREIGN PATENT DOCUMENTS

DE 1023177 B 1/1958
DE 3339059 A1 9/1984
(Continued)

OTHER PUBLICATIONS

International Search Report (dated Mar. 31, 2014) for corresponding International App. PCT/SE2013/000114.
(Continued)

*Primary Examiner* — Woody Lee, Jr.
*Assistant Examiner* — Sang K Kim
(74) *Attorney, Agent, or Firm* — WRB-IP LLP

(57) ABSTRACT

A heat exchanger system for a vehicle includes at least one heat exchanger, a centrifugal fan assembly for improving the flow of air through the at least one heat exchanger, the fan assembly including a rotatably mounted impeller with a plurality of impeller blades, and a rotatable inlet shroud for guiding the air flow entering the impeller; and a stationary inlet shroud located between the at least one heat exchanger and the fan assembly and configured for directing air exiting the at least one heat exchanger towards the rotatable inlet shroud of the fan assembly. The fan assembly further includes a stator with a plurality of stationary stator blades located radially or semi-radially outside the impeller for conversion of fluid dynamic pressure to fluid static pressure of the air flow.

18 Claims, 9 Drawing Sheets

(51) Int. Cl.

| | |
|---|---|
| ***F04D 17/10*** | (2006.01) |
| ***F04D 29/16*** | (2006.01) |
| ***F04D 29/44*** | (2006.01) |
| ***F01P 1/06*** | (2006.01) |
| ***F04D 29/08*** | (2006.01) |
| ***F04D 29/28*** | (2006.01) |
| ***F04D 29/58*** | (2006.01) |
| ***F04D 17/16*** | (2006.01) |

(52) U.S. Cl.
CPC ..... *F04D 17/16* (2013.01); *F04D 29/083* (2013.01); *F04D 29/162* (2013.01); *F04D 29/281* (2013.01); *F04D 29/444* (2013.01); *F04D 29/5826* (2013.01); *F05D 2250/52* (2013.01)

(58) Field of Classification Search
CPC .... F04D 29/083; F04D 29/162; F04D 29/281; F04D 29/444; F04D 29/5826; F05D 2250/52
See application file for complete search history.

(56) References Cited

U.S. PATENT DOCUMENTS

| | | | | |
|---|---|---|---|---|
| 4,946,348 | A | 8/1990 | Yapp | |
| 5,423,660 | A * | 6/1995 | Sortor | F01P 5/06 416/189 |
| 6,450,765 | B1 | 9/2002 | Carroll et al. | |
| 6,827,547 | B2 * | 12/2004 | Robb | F04D 29/582 415/1 |
| 7,462,013 | B2 * | 12/2008 | Iwasaki | F04D 29/545 415/169.2 |
| 8,454,300 | B2 * | 6/2013 | Stagg | F04D 29/526 415/208.2 |
| 8,573,931 | B2 * | 11/2013 | Blass | F01P 5/06 415/176 |
| 8,714,921 | B2 * | 5/2014 | Tembreull | F01P 11/10 415/208.1 |
| 2002/0004008 | A1 | 1/2002 | Miyata | |
| 2006/0147304 | A1 | 7/2006 | Cho et al. | |
| 2007/0160468 | A1 * | 7/2007 | Tsubota | F01P 5/06 415/173.6 |
| 2010/0247351 | A1 | 9/2010 | Kleber | |

FOREIGN PATENT DOCUMENTS

| | | | |
|---|---|---|---|
| DE | 9016496 | U1 | 3/1991 |
| DE | 102011121624 | A1 | 6/2013 |
| GB | 2116642 | A | 9/1983 |
| WO | 9837319 | A1 | 8/1998 |

OTHER PUBLICATIONS

International Preliminary Report on Patentability (dated Nov. 11, 2015) for cprresponding International App. PCT/SE2013/000114.
European Search Report (dated Jan. 26, 2017) for corresponding European App. EP 13 88 8962.

* cited by examiner

HEAT EXCHANGER SYSTEM FOR A VEHICLE

BACKGROUND AND SUMMARY

This disclosure relates to a heat exchanger system for a vehicle. The heat exchanger system comprising at least one heat exchanger; a centrifugal fan assembly for improving the flow of air through the heat exchanger, the fan assembly comprising a rotatably mounted impeller with a plurality of impeller blades, and a rotatable inlet shroud for guiding the air flow entering the impeller; and a stationary inlet shroud located between the at least one heat exchanger and the fan assembly and configured for directing air exiting the at least one heat exchanger towards the inlet shroud of the fan assembly. The disclosure also relates to vehicle comprising such a heat exchanger system. The heat exchanger system according to the disclosure may typically used in vehicles such as automobiles, trucks, busses, construction vehicles, marine vehicles, etc.

As output power demand of combustion engines continues to increase so does the cooling effect required to prevent the combustion engines from over-heating. Improving and increasing the flow of air through the heat exchanger is one option for realising increased cooling effect of a machine cooling system. A fan assembly for a mobile machine cooling system having a centrifugal fan and reduced leakage is known U.S. Pat. No. 6,450,765 B1. There is however still need for improvements with respect to increased cooling and fan efficiency.

It is desirable to provide a heat exchanger system for a vehicle where the previously mentioned problem is at least partly avoided.

The disclosure concerns, according to an aspect thereof, a heat exchanger system for a vehicle. The heat exchanger system comprising at least one heat exchanger; a centrifugal fan assembly for improving the flow of air through the at least one heat exchanger, the fan assembly comprising a rotatably mounted impeller with a plurality of impeller blades, and a rotatable inlet shroud for guiding the air flow entering the impeller; and a stationary inlet shroud located between the at least one heat exchanger and the fan assembly and configured for directing air exiting the at least one heat exchanger towards the inlet shroud of the fan assembly.

The disclosure, according to an aspect thereof, is characterized in that the fan assembly further comprising a stator with a plurality of stationary stator blades located radially or semi-radially outside the impeller for conversion of fluid dynamic pressure to fluid static pressure of the air flow.

It is desirable to increase the static efficiency provided by the fan assembly because the air flow through the heat exchanger generated by the fan assembly is directly coupled to the static pressure difference before and after the heat exchanger. An increased static pressure difference generally results in increased through flow of air, such that improved cooling effect is obtained. Since the total pressure of any point of an air flow is the sum of static pressure and dynamic pressure, the static pressure of a point of the air flow can be increased by decreasing the dynamic pressure of the air flow at that point. Static pressure can be considered representing the potential energy put into the system by the fan. Dynamic pressure, also referred to as velocity pressure, is the kinetic energy of a unit of air flow in an air stream, and is a function of air flow speed and density. Consequently, by reducing the speed of the air flow the static pressure of the air flow increases. Conversion of air flow dynamic pressure into air flow static pressure is realised partly by recovering swirl energy (rotating flow velocity pressure) and partly by controlled radial diffusion of the outlet air flow. By straightening the air flow downstream of the impeller the rotational component of air movement caused by the rotation of the impeller is reduced, such that the total kinetic energy of the outlet flow is reduced, and by increasing the flow area in the downstream flow direction through the stator the flow speed is decreased and the static pressure increased correspondingly. Consequently, the cooling efficiency of the heat exchanger system is improved.

According to an aspect of the disclosure, an elastic seal is provided for sealing the gap between the stationary inlet shroud and fan assembly. The elastic seal is provided between two non-rotating members of the heat exchanger system. The stationary inlet shroud is relatively rigidly mounted to a chassis of the vehicle, whereas the fan assembly is mounted to the combustion engine of the vehicle. The combustion engine depending in its design, configuration and setting will generate more or less strong vibrations, and the chassis sometimes exhibit relatively strong vibrations due to driving on uneven roads. Consequently, the combustion engine is generally mounted to the chassis via elastic engine mounts, which serve to absorb much of the vibrations and to prevent the vibrations from being transmitted to and from the chassis for reasons of noise reduction and driver comfort. However, as a result of the elastic engine mounting, the relatively large amplitude vibrations and motion may occur between the engine and chassis. Moreover, since the fan assembly is generally powered mechanically by the crankshaft of the combustion engine the fan assembly is generally mounted to the engine. As a result, the gap between the stationary inlet shroud and fan assembly will exhibit relatively large dimensional variations. The elasticity of the elastic seal enables the seal to provide a high sealing capacity despite the potentially large relative motion of the stationary inlet shroud and the fan assembly. The elastic seal may exhibit corrugations or bellows for improved flexibility. The purpose of the elastic seal is to prevent air from outside the stationary inlet shroud from entering being sucked into the fan assembly. Thereby, leakage into the fan assembly is reduced and more air will instead be forced to pass through the heat exchanger for improved cooling efficiency.

According to an aspect of the disclosure, the elastic seal is fastened to at least one of the stationary inlet shroud and the member mounted to the propulsion source. The elastic seal may be fastened by means of any type of mechanical fastener, such as screws, rivets, clamping members, etc., and/or by an adhesive, and/or by welding, heat bonding, etc. The elastic seal may be fastened to one of the stationary inlet shroud and the member mounted to the propulsion source and simply abutting the other part with pretension, or fastened to both parts.

According to an aspect of the disclosure, the elastic seal is fastened to at least one of the stationary inlet shroud and the stator or a member fastened to the stator. Using the stator, or a member fastened to the stator as contact surface simplifies the design because the stator is located close to the stationary inlet shroud. The relatively small gap between the stationary inlet shroud and stator enables a more robust and reliable elastic seal mounting. The member fastened to the stator may for example be a stator sealing arrangement for sealing the gap between the stator and impeller, a stator shroud that extends forwards from the stator or a sealing arrangement that is supported by the stator shroud.

According to an aspect of the disclosure, the elastic seal is fastened to at least one of the stationary inlet shroud and a support member mounted to the propulsion source rearwards of the stator or a member fastened to said support member. If for some reason the stator cannot be used for sealing surface for the elastic seal then the support member mounted to the propulsion source rearwards of the stator may be used instead. The design is less robust because of the length of the axial support member, which also must pass over the outlet of the fan. Possibly, the support member may be attached to the engine using one or more attachment points in common with the fan assembly.

According to an aspect of the disclosure, the elastic seal comprises an elastic sealing sleeve. The elastic sealing sleeve is preferably made of rubber or a resilient plastic material.

According to an aspect of the disclosure, the radial gap between the impeller blades and stator blades is sealed by at least one sealing arrangement for preventing air leaking in or out of the gap. The radial gap may be provided with a sealing arrangement on the forward side and/or the rearward side of the fan assembly. Depending on the static pressure within the gap and the regions directly outside the gap, air will tend to leak in or out of the gap. The sealing arrangement is preferably realised by means of a non-contact sealing arrangement for avoiding friction and noise and wear of the parts. A non-contact sealing arrangement is a labyrinth-type sealing arrangement, where the leakage air is forced to change direction within the sealing arrangement at least one time. Alternatively, a contact sealing arrangement may be implemented, for example by means of a brush or other sliding-type sealing arrangements.

According to an aspect of the disclosure, the fan assembly inlet is sealed by at least one sealing arrangement for preventing air leaking into the fan assembly, wherein the sealing arrangement is arranged to seal a gap between the rotatable inlet shroud and a member mounted to the propulsion source. Since both the rotatable inlet shroud and said member are mounted to the propulsion source, their internal relative motion will be relatively small, such that a sealing arrangement having small dimensional tolerances can be implemented. In a non-contact sealing arrangement, such as a labyrinth-type sealing arrangement, the sealing performance is directly dependent on how small the air leakage path is. A non-contact sealing arrangement designed for small dimensional tolerances will consequently have a higher sealing performance than a non-contact sealing arrangement designed for high dimensional tolerances.

According to an aspect of the disclosure, the sealing arrangement is arranged to seal a gap between the rotatable inlet shroud and a stator shroud that extends forwards from the stator. This design enables the same advantageous effect as the previous aspect of the disclosure, namely an improved sealing performance due to the fact that both the rotatable inlet shroud and the stator shroud are mounted to the propulsion source, thereby enabling the sealing arrangement to have small dimensional tolerances. Moreover, the stator shroud also shields the sealing arrangement from air outside of the stator, such that only air leaking out of the radial gap between the impeller and stator will reach the sealing arrangement, thereby significantly reducing the possible leakage flow.

According to an aspect of the disclosure, the at least one sealing arrangement is of a labyrinth-type sealing arrangement. This type of seals as non-contact type seals that exhibits zero frictional losses and wear when correctly installed.

According to an aspect of the disclosure, the at least one labyrinth-type sealing arrangement of the heat exchanger system is configured for enabling axial mounting and/or dismounting of the stator and impeller. By arranging the labyrinth-type sealing arrangement properly it can be mounted merely be sliding the parts axially towards each other. This enables simplified single-piece design of the labyrinth-type sealing arrangement that otherwise must be divided in an axial plane into at least two parts for being assembled. Furthermore, of two or more labyrinth-type sealing arrangements are provided, for example also for sealing the radial gap between the impeller and stator, then axially consecutive labyrinth-type sealing arrangements must be have a consistent increasing or consistent decreasing radial offset from a rotational axis of the fan assembly.

According to an aspect of the disclosure, flow straightening devices are provided for straightening any air flow leaking out from the radial gap between the impeller blades and stator blades and back into the inlet air flow upstream of the impeller. The leakage flow out of the radial gap has except for an axial flow direction additionally a rotational swirl component due to the rotation of the impeller. The inlet flow from the heat exchanger into the impeller has however a more or less pure axial flow. For minimising any potentially negative effects on fan assembly efficiency due to flow distortions upstream of the impeller the rotational swirl component is reduced by means of the flow straightening devices. These may comprise a plurality of substantially axial or slightly curved blades that are located within the leakage air flow.

According to an aspect of the disclosure, sliding contact members made of rubber or plastic material are provided between the impeller and the stator, or any parts that are fastened or associated with the impeller and the stator, for preventing undesired noise and vibrations during occurrences of contact with each other.

According to an aspect of the disclosure, the impeller further comprises a back plate for structurally connecting the rotatable blades with a rotatable shaft of the impeller. The back plate may have a disc-shape arranged in a radial plane for a compact design, or a conical shape.

According to an aspect of the disclosure, the heat exchanger is arranged such that air flow during use of the heat exchanger system is configured to flow through the heat exchanger in a direction substantially coaxial with rotational axis of the impeller.

According to an aspect of the disclosure, the stator shroud is integrally formed with stator. This design tends to provide less total weight, reduced manufacturing costs and improved robustness.

According to an aspect of the disclosure, the rotatable inlet shroud is integrally formed with the impeller. This design tends to provide less total weight, reduced manufacturing costs and improved robustness According to an aspect of the disclosure, the rotatable inlet shroud forms together with a side portion of the impeller a U-shaped cross-section that is open towards the radial outside. Air flowing towards the inlet of the impeller will thus be guided around the U-shaped cross-section with low flow distortion due to the rounded form, such that high fan efficiency can be maintained.

According to an aspect of the disclosure, the stator is divided in an axial plane into at least two parts. This enables mounting and dismounting of the impeller in a radial plane without disassembly of the impeller.

BRIEF DESCRIPTION OF DRAWINGS

In the detailed description below reference is made to the following figure, in which.

DETAILED DESCRIPTION

Various aspects of the disclosure will hereinafter be described in conjunction with the appended drawings to illustrate and not to limit the disclosure, wherein like designations denote like elements, and variations of the described aspects are not restricted to the specifically shown embodiments, but are applicable on other variations of the disclosure.

Figure 1A:
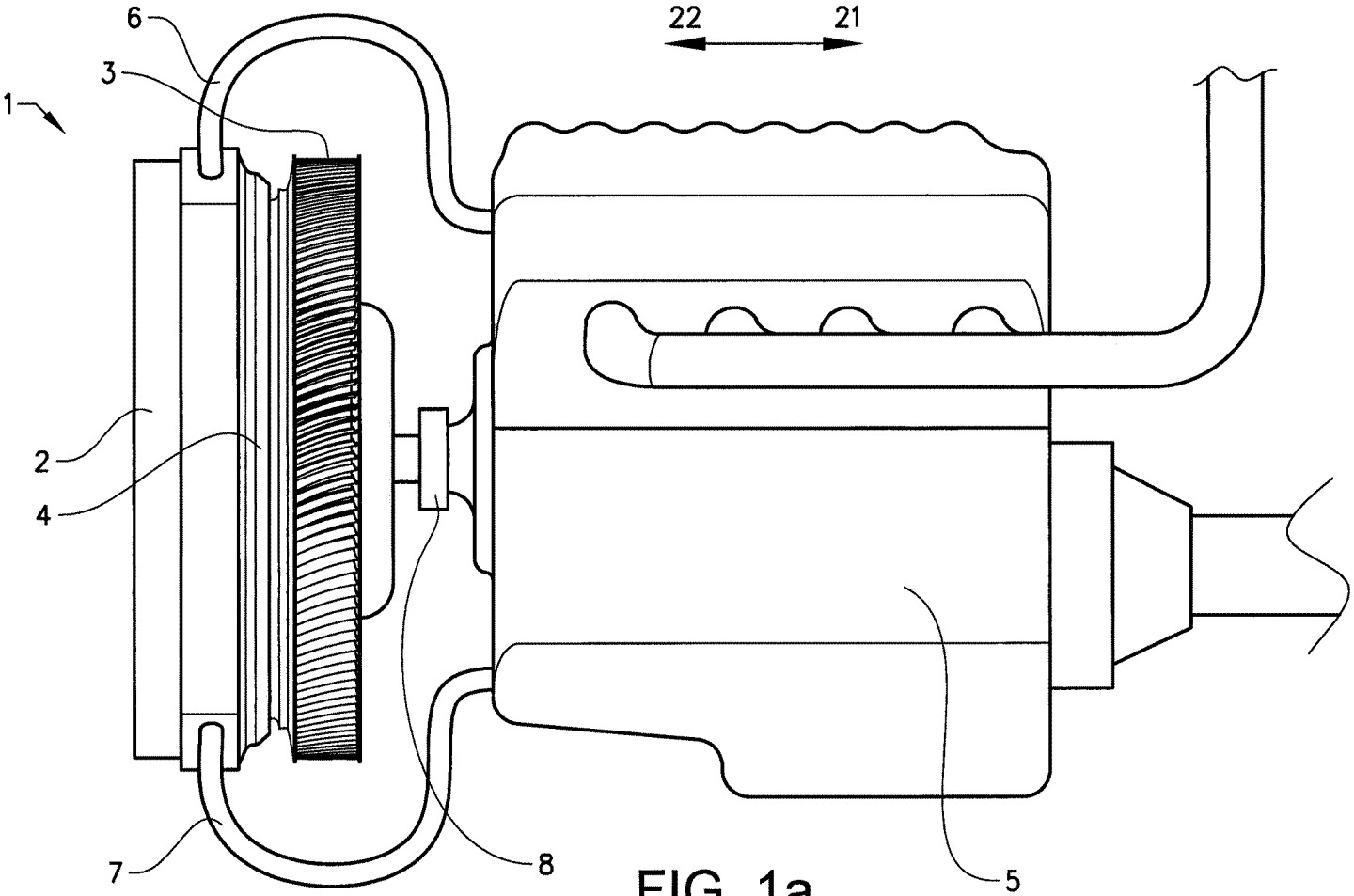
FIG. 1*a* shows an overview of a heat exchanger system according to the disclosure connected to a combustion engine.

FIG. 1*a* shows a side view of the heat exchanger system 1 comprising a heat exchanger 2, a centrifugal fan assembly 3 and a stationary inlet shroud 4 located between the heat exchanger 2 and the fan assembly 3. The heat exchanger system 1 is suitable for cooling a circulating cooling fluid of an engine 5, whereby hot cooling fluid from the engine 5 enters for example the top of the heat exchanger 2 via a first fluid pipe 6 and is conveyed back to the engine via a second fluid pipe 7. The heat exchanger 2 is arranged to enable the surrounding air to absorb some of the heat of the cooling fluid, such that less hot cooling fluid is led back to the engine 5. The heat absorption capacity of the air flowing through the heat exchanger 2 is dependent on the air flow rate. A high flow rate results in that heated air is quicker replaced with new cool air, such that a higher heat transfer capacity is attained. An impeller of the fan assembly 3 may be located on a shaft 8 that is mechanically connected to and driven by the crankshaft of the engine 5 via a variable fan clutch (non-showed), which enables variable output power to the fan assembly 3. The fan clutch may be of a visco-type clutch. An electric, pneumatic, hydraulic or any other kind of motor may alternatively be arranged for powering the fan assembly 3.

Figure 1B:
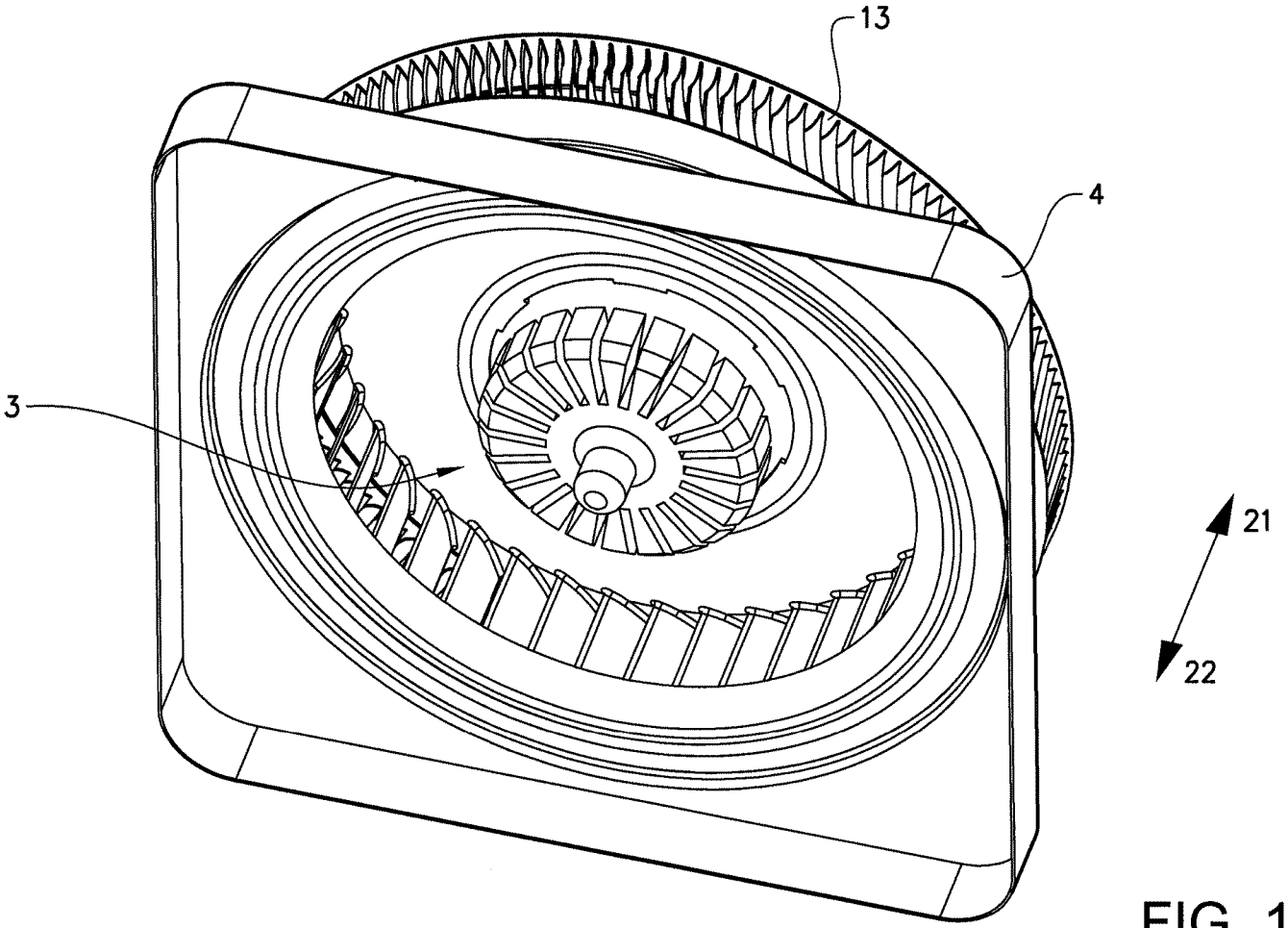
FIG. 1*b* shows a perspective view of the fan assembly and stator according to a first embodiment of the disclosure.
Figure 1C:
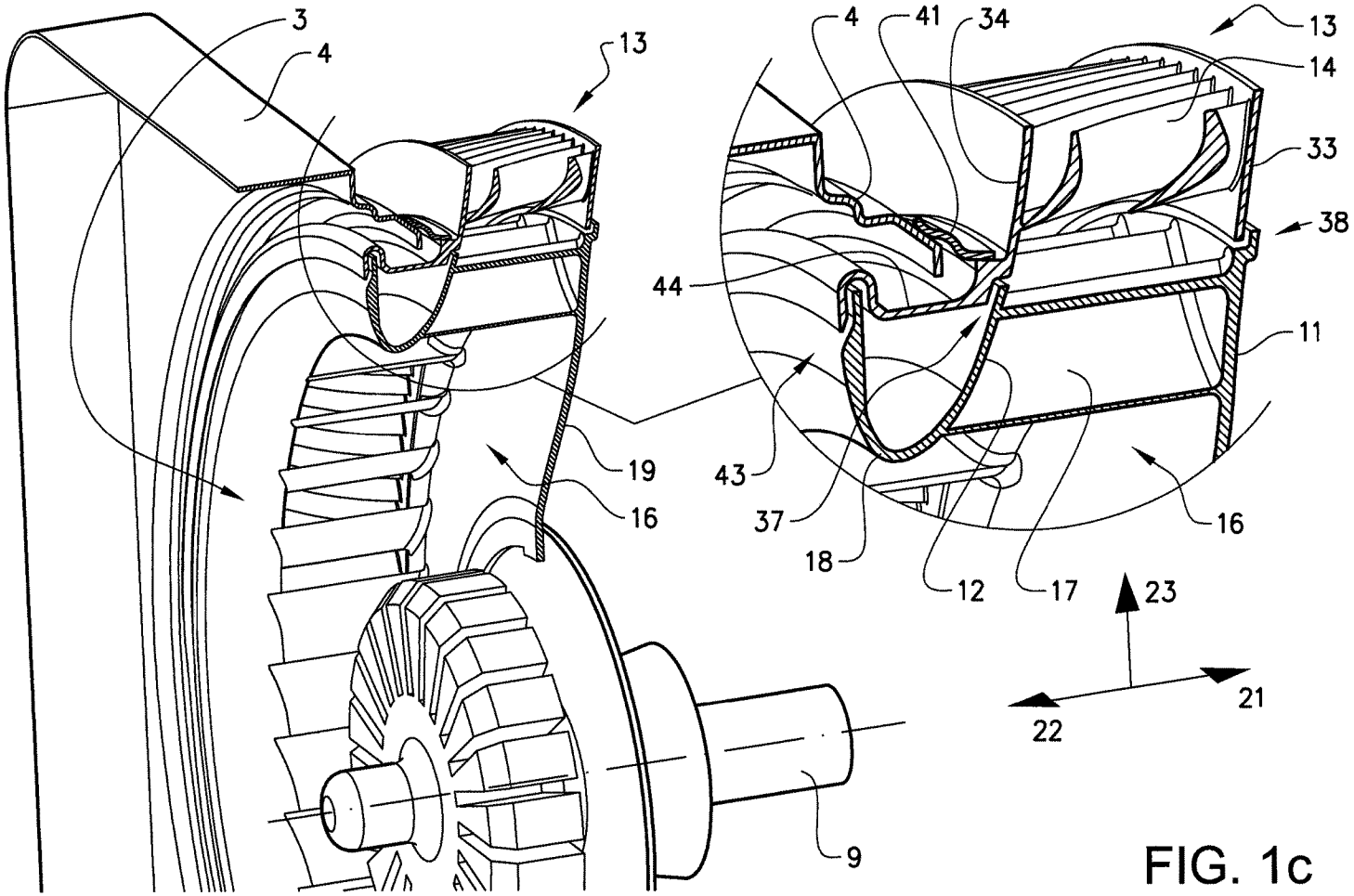
FIG. 1*c* shows a more detailed cross-sectional view of the assembly of FIG. 1*b;*

FIG. 1*b* shows a perspective view of the fan assembly 3, stationary inlet shroud 4 and a stator 13 according to a first embodiment of the disclosure, and FIG. 1*c* shows a cross-section of the same assembly from a different view. The heat exchanger 2 is here not showed. The system components relative location will be described in terms of their axial location in the axial direction, and a rearward axial direction is defined by arrow 21, a forwards axial direction is defined by arrow 22 and a radial direction, which is perpendicular to axial direction, is defined by arrow 23. The stationary inlet shroud 4 serves to guide air exiting the heat exchanger 2 towards the fan assembly 3, to adapt a rectangular shape of the heat exchanger 2 to the circular shape of the fan assembly 3, as well as reducing leakage of air as will be discussed more in detail later in the disclosure.

The fan assembly 3 generally has a circular shape seen from a front direction. The fan assembly 3 comprises a rotatably mounted impeller 16 with a plurality of impeller blades 17, and a rotatable inlet shroud 18 for guiding the air flow entering the impeller 16. The impeller 16 comprises a back plate 19 for structurally connecting the rotatable blades 17 with the rotatable shaft 9 of the impeller 16. The backplate 19 may have a slightly conical shape and inclined in the rearward direction 21. The plurality of impeller blades 17 may be inclined with respect to the radial direction and in a side-view have a shape resembling a parallelogram, rhomboid or rectangular shape with an elongation in the axial direction. The radially inner and outer edges of the blades 17 may be arranged substantially aligned with the axial direction. Alternatively, the radially inner and/or outer edges of the blades 17 may be inclined to generate a more rearwards directed flow of air exiting the fan assembly 3, thereby resembling a mixed flow fan. The impeller 16 comprises preferably at least 10 blades, more preferably at least 20 blades, and still more preferably at least 30 blades. The blades 17 are supported by at least one impeller flange. Preferably, the blades are supported between a first impeller flange 12 and a second impeller flange 11 that is spaced axially apart from the first flange 12. The blades 17 are connected to the first and second impeller flanges 12, 11 on opposing edges. The rotatable inlet shroud 18 extends forwards from the impeller 16 towards the stationary inlet shroud 4. The rotatable inlet shroud 18 serves to guide the incoming air to the impeller 16 for reducing flow distortions near and within the impeller 16. For this purpose, the rotatable inlet shroud 18 exhibits together with the second flange 12 of the impeller a U-shaped cross-section that is open towards the radial outside. The rotatable inlet shroud 18 is preferably formed integrally with the impeller 16 in a single piece, but may alternatively be formed as two parts that are subsequently assembled.

A stator 13 comprising a plurality of stationary stator blades 14 located radially or semi-radially outside the impeller 16 for conversion of fluid dynamic pressure to fluid static pressure of the air flow. Both the impeller 16 and stator 13 are mounted to the propulsion source 5, such that their internal relative movement is relatively small. These small relative movements enable small dimensional and assembly tolerances, such that high performance seals can be designed. There fan assembly 3 is free from a housing surrounding the impeller 16 and guiding the air flow exiting the impeller 16 to one or more selected outlets. Instead, air exiting the impeller 16 and stator 13 is free to flow in substantially all radial and mixed radial/axial directions, except when possibly encountering surrounding engine components, such as pipes, etc. The stator 13 has an annular shape. The stator 13 comprises a large number of blades 14, preferable more than the number of blades 17 of the impeller 16, and preferably at least 40 blades, more preferably at least 50 blades, and still more preferably at least 60 blades. The blades 14 are supported by at least one stator flange. Preferably, the blades 14 are supported between a first stator flange 34 and a second stator 33 flange that is spaced axially apart from the first flange 34. The blades 14 are connected to the first and second stator flanges 34, 33 on opposing edges. Each of the stationary inlet shroud 4, impeller 16 and stator 13 is preferably made of plastic or composite material, but the impeller may alternatively be made of a metal material or mixed metal/plastic material. The heat exchanger system according to the first embodiment further comprises a first, second and third sealing arrangement 37, 38, 43, an annular stator shroud 44 and an elastic seal 41, which parts will be described more in detail below, in particular in relation to FIG. 3 and FIG. 4.

Figure 2:
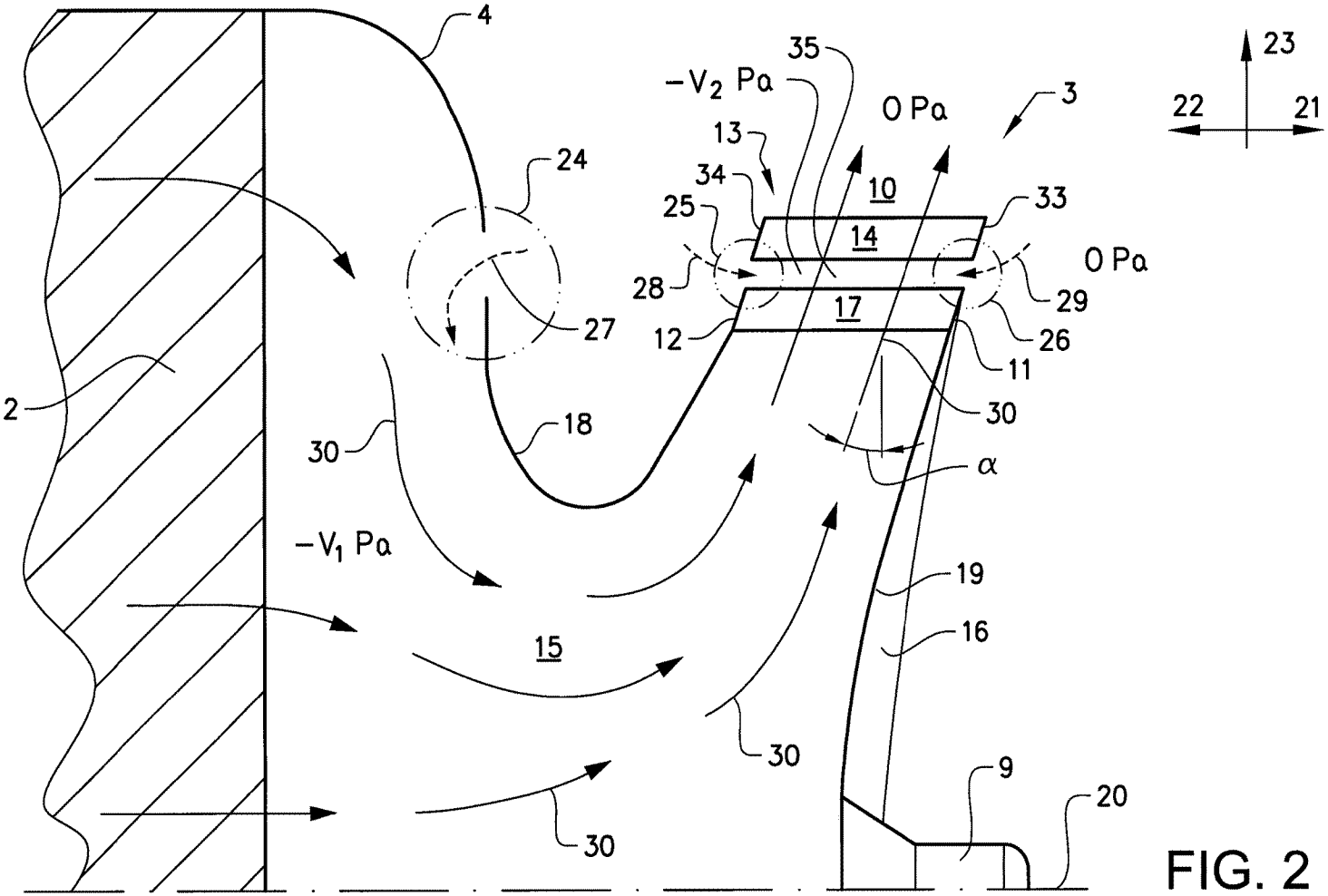
FIG. 2 shows a cross-sectional view of the heat exchanger system according to a second embodiment.

FIG. 2 shows a more schematic cross-sectional view of the heat exchanger system 1 according to a second embodiment. A rotational axis 20 is shown extending in the axial direction. The heat exchanger 2 is arranged such that during use of the heat exchanger system 1 air flows substantially in an axial direction through the heat exchanger 2. The stationary inlet shroud 4 is preferably mounted to the heat exchanger 2 but may alternatively be mounted directly the chassis of the vehicle. The flow direction just outside the outlet 10 of the fan assembly 3 is preferably slightly inclined rearwards with an angle a for enabling the fan assembly 3 having a through flow with low level of distortions. However, a fan assembly 3 generating a more radial flow at the outlet 10 of the fan assembly 3 is possible, especially when the axial space of the heat exchanger system 1 should be minimised.

The purpose of the centrifugal fan assembly 3 is to increase the flow rate of air through the heat exchanger system 1 for increasing the cooling capacity of the heat exchanger system 1. During operation of the fan assembly 3 it creates a negative static pressure VI Pascal (Pa) in the area rearwards of the heat exchanger 2 and at the inlet 15 of the fan assembly 3, such that a pressure difference is created axially over the heat exchanger 2. This axial pressure difference induces the desired axial flow of air through the heat exchanger 2. The air flow through the heat exchanger system 1 is schematically illustrated by arrows 30 in FIG. 2-6*b*.

The air pressure surrounding the heat exchanger system 1 is here simplified set to 0 Pa pressure gauge for schematically illustrating the pressure distribution within and surrounding the heat exchanger system 1. The stator 13 induces a certain negative static pressure $V_2$ Pa within the radial gap 35 between the impeller blades 17 and stator blades 14 due to the higher air flow speed within the radial gap 35 than downstream of the stator 13. The static pressure Vi at the inlet of the impeller 16 is the sum of the pressure-difference between the impeller inlet and outlet and the pressure difference between the stator inlet and outlet. The static pressure difference of the impeller may typically be about 5-10 times larger than the static pressure difference $V_2$ of the stator. Obviously, essentially all surrounding air having a pressure gauge of about 0 Pa will tend to flow to the negative pressure area rear of the heat exchanger 2 and within the fan assembly 3 and three leakage areas can be identified. A first leakage area 24 is formed at the gap between the stationary inlet shroud 4 and fan assembly 3, a second leakage area 25 is formed at the forward end of the radial gap 35 between the impeller blades 17 and stator blades 14, and a third leakage area 26 is formed at the rearward end of the radial gap 35. Leakage flow is indicated by first, second and third dashed arrows 27, 28, 29 respectively.

Air leakage has a negative effect on fan efficiency and solutions for reducing the leakage is shown in the other embodiments of the disclosure. Since both the impeller 16 and stator 13 are mounted to the engine 5 they exhibit relatively low relative structural motion, i.e. the shape and location of the radial gap 35 between the impeller 16 and stator 13 is relatively stable, thereby enabling efficient use of non-contact sealing arrangements, such as labyrinth-type sealing arrangements. The stationary inlet shroud 4 however is mounted to the chassis, such that relatively large amplitude relative motion occurs at the first leakage area 24. The first leakage area 24 is therefore not suitable for being sealed with a non-contact sealing arrangement such as a labyrinth-type sealing arrangement, because non-contact sealing arrangement tend to have a poor performance when the leakage path through the sealing arrangement is too large. And if a labyrinth-type sealing arrangement having a small internal leakage path is provided it will have problems with contact between different parts forming the sealing, such that damages, noise and increased friction may occur.

Figure 3:
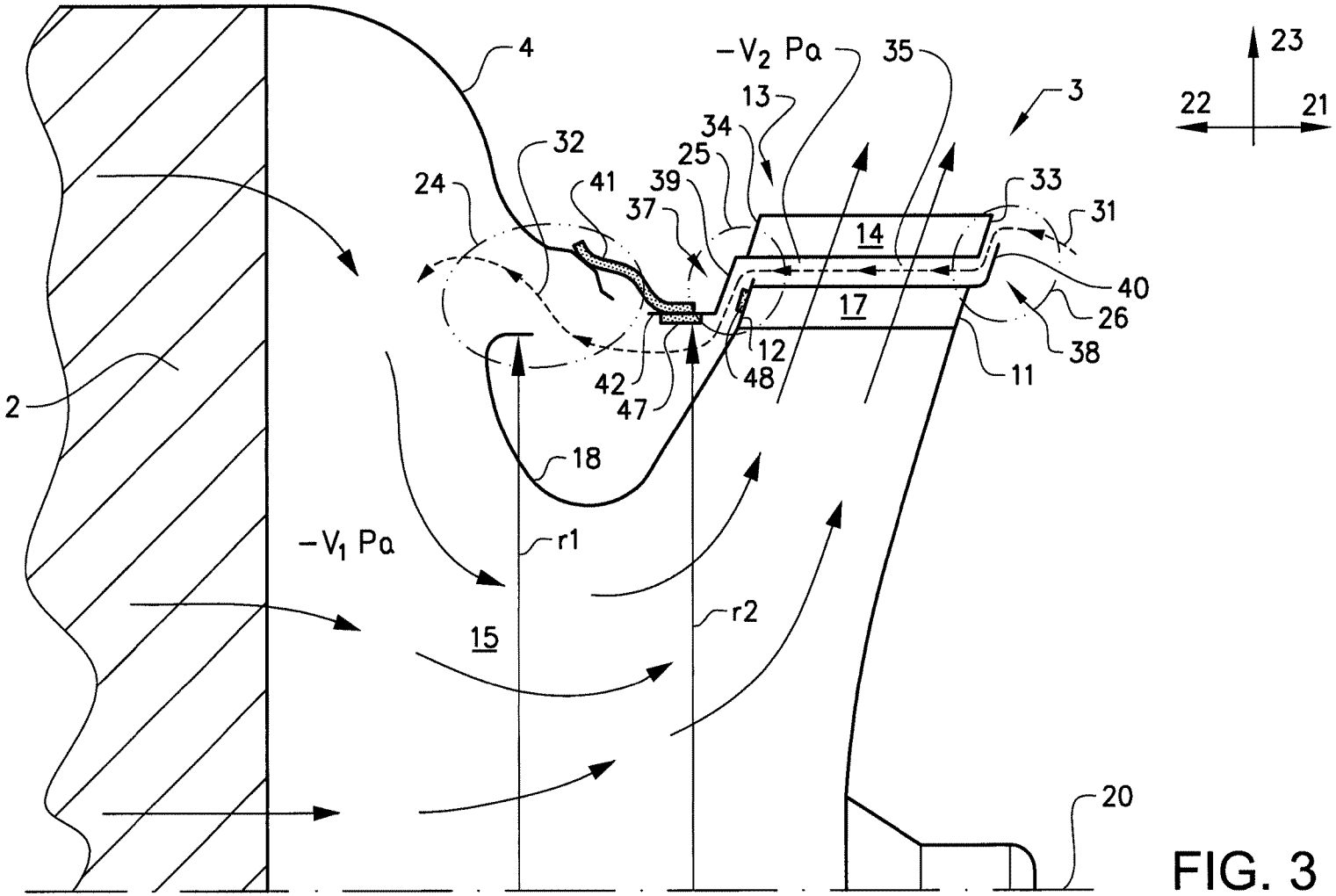
FIG. 3 shows a cross-sectional view of the heat exchanger system according to a third embodiment.

A third embodiment of the heat exchanger system 1 is shown in FIG. 3. The second and third leakage areas 25, 26 are each sealed by first and second labyrinth-type sealing arrangements 37, 38 respectively. The first labyrinth-type sealing arrangement 37 comprises an annular projecting shield 39 extending from the first stator flange 34 and axially covering the radial gap 35. Similarly, the second labyrinth-type sealing arrangement 38 comprises an annular projecting shield 40 extending from the second impeller flange 11 and axially covering the radial gap 35. Air entering or exiting the radial gap 35 must consequently change direction at least once, such that a tortuous path for the leaking air provided, thereby reducing leakage. Furthermore, the first leakage area 24 is sealed by means of an elastic seal 41, which seals the gap between the stationary inlet shroud 4 and fan assembly 3. The elasticity form and size of the elastic seal 41 is selected to uphold the sealing performance also upon large amplitude internal motion between the stator 13 and stationary inlet shroud 4.

The elastic seal 41 is fastened to at least one of the stationary inlet shroud 4 and the stator 13. Preferably, the elastic seal 41 is fastened to one of the stationary inlet shroud 4 and the stator 13 and only abutting the other part under pre-stress. Thereby the assembly and disassembly of the parts is simplified. A further aspect for improving manufacturing and servicing of the heat exchanger system 1 is to make the fan assembly 3 axially mountable/dismountable without need for removal of the first and second sealing arrangements 37, 38. This is here attained by keeping the maximal radial extension ii of the rotatable inlet shroud 18 smaller than the minimum radial extension $r_2$ of the stator side of the first labyrinth-type sealing arrangement 37, and by providing the annular projecting shield 39 of the first labyrinth-type sealing arrangement 37 on the stator and the annular projecting shield 40 of the second labyrinth-type sealing arrangement 38 on the impeller 16. Thereby, the impeller 16 and stator 13 can be disassembled simply by axial relative displacement.

In the embodiment of FIG. 3, the elastic seal 41 contacts an extension 42 of the first labyrinth-type sealing arrangement 37. The elastic seal 41 comprises an elastic sealing sleeve. The rotatable inlet shroud 18 ends at a safe distance from the stationary inlet shroud 4 for eliminating any mutual contact also during severe relative vibration motion. A first leakage flow 31 will flow through the second labyrinth-type sealing arrangement 38 and enter the radial gap 35 at the third leakage area 26. A second leakage flow 32 will, due to the pressure difference between the radial gap 35 ($-V_2$ Pa) and the inlet of the fan assembly 15 (−V1 Pa), flow out of through the first labyrinth-type sealing arrangement 37 and into the inlet 15 of the fan assembly 3. However, the first and second leakage flows 31, 32 are small and enable a high cooling and fan efficiency.

The fan assembly 3 may further be provided with stationary flow straightening devices 47 for straightening any air flow leaking out from the radial gap 35 between the impeller blades 17 and stator blades 14 and back into the inlet 15 of the impeller 16. The air flow leaking out from the radial gap 35 has a rotational motion component due to the rotational movement of the impeller 16, as well as an axial motion component induced by the leakage flow. The air flow entering the fan assembly at the inlet 15 has however mainly an axial motion component. The mixture of the axial/radial leakage flow with the axial inlet flow from the heat exchanger may give raise to flow distortions in the area of mixture and behind, which distortions has a negative effect on fan efficiency. By providing flow straightening devices 47 for straightening any air flow leaking out from the radial gap 35 the distortions will decrease. The flow straightening devices 47 are preferably realised by a plurality of circumferentially spaced apart projecting blades that extend more or less in the axial direction. The blades may have, seen in a forward direction, a reduced inclination with respect to the axial direction curvature for straightening the swirling leakage flow to a more straight axial flow. The blades may be provided internally in the area of the first and/or third sealing arrangements 37, 43 and/or on the interior side of the stator shroud 44. The blades preferably project from a support surface so as to extend into the leakage flow.

The impeller 16 and/or stator 13 may further comprise sliding contact members 48 for reducing noise, damages and vibration upon any contact between the rotating impeller 16 and stationary stator 13. The contact members are preferably realised by a plurality of circumferentially spaced apart projections made of rubber or plastic material. The projections may typically be provided axially between any impeller and stator parts. In FIG. 3, the contact members 48 are secured to the first flange 12 of the impeller 16 and projection axially in the direction of the annular shield 39 of the stator 13. In case of excessive vibrations the stator 13 and impeller 16 may contact each other then it is better if the induced contact stress is transferred via the contact members 48. Obviously, the contact members may have many other forms, sizes and shapes and be located in various other locations between the impeller 16 and stator 13, or any parts that are fastened or associated with the impeller 16 and stator 13. The contact members 48 and flow straightening devices 47 may alternatively be combined into a single piece by providing the flow straightening devices 47 on a stationary part of the first sealing arrangement 37 and forming them to withstand a certain level of contact with the impeller upon mutual sliding contact.

Figure 4:
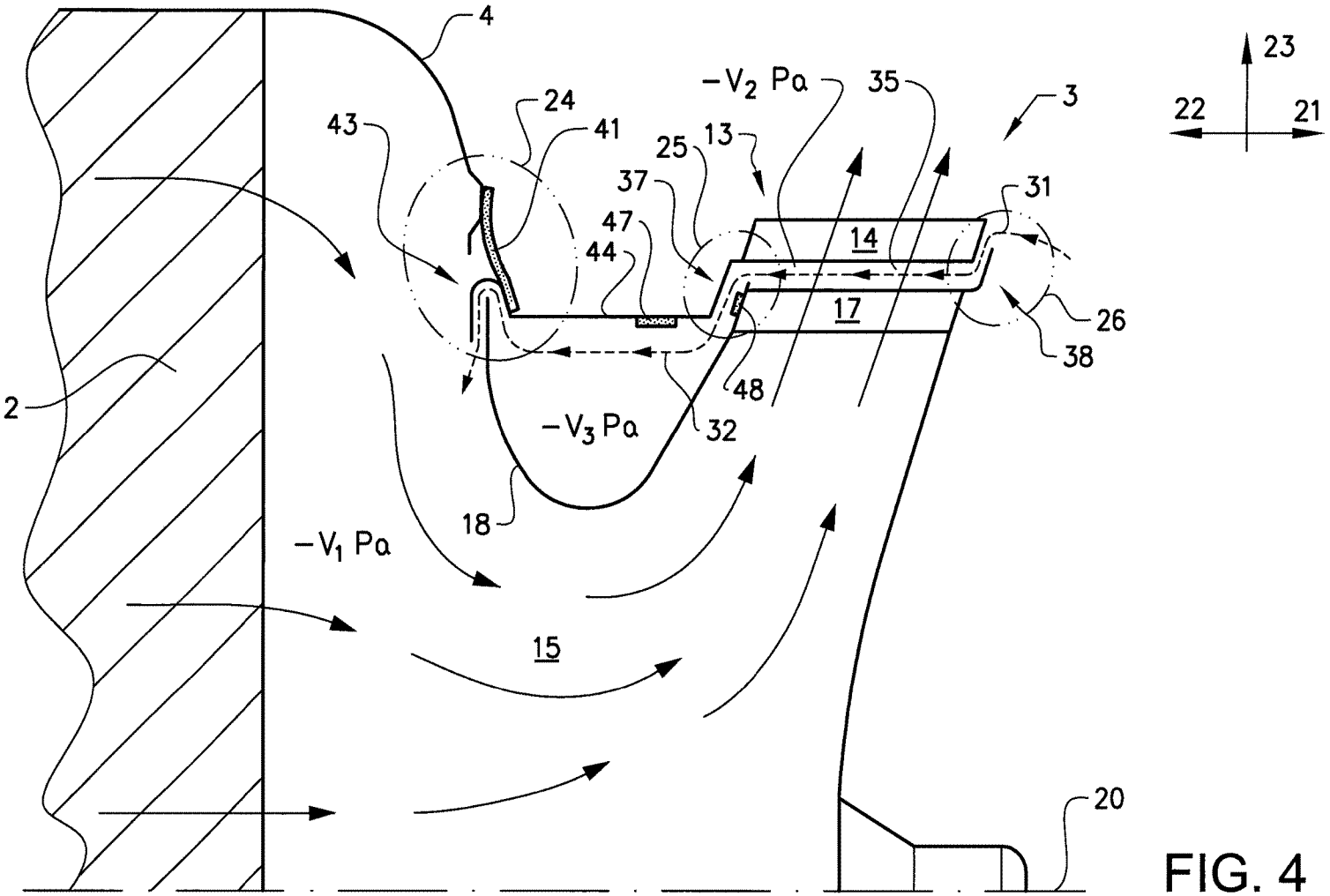
FIG. 4 shows a cross-sectional view of the heat exchanger system according to a fourth embodiment.

A fourth embodiment of the heat exchanger system 1 is shown in FIG. 4. Many aspects of this embodiment is identical those of the third embodiment, but with the difference that the second leakage flow 32 is further reduced for improved fan efficiency. The second leakage flow 32 is reduced by adding an additional labyrinth-type sealing arrangement along the path of the second leakage flow 32, namely at the fan assembly inlet 15. This third labyrinth-type sealing arrangement 43 is arranged to seal the gap existing between the rotatable inlet shroud 4 and an annular stator shroud 44 that extends forwards from the stator 13. The stator shroud 44 is preferably integrally formed with stator 13 and assists in effectively preventing any leakage from the outside of the fan assembly 3 from entering the inlet 15 of the fan assembly 3. Since both the stator shroud 44 and rotatable inlet shroud 18 are mounted to the engine 5 they will exhibit small internal relative motion, such that a high performance seal with small tolerances can be provided at third labyrinth-type sealing arrangement 43. The elastic seal 41 is here arranged to sealingly contacting the stationary inlet shroud 4 and part of the third labyrinth-type sealing arrangement 43. However, the elastic seal 41 may alternatively sealingly contact other parts of the stator 13 or stator shroud 44. By means of the third labyrinth-type sealing arrangement 43 the intermediate air volume located between the first and third labyrinth-type sealing arrangements 37, 43 exhibits an intermediate negative static pressure $V_3$ Pa. The intermediate negative static pressure $V_3$ will be lower than the pressure $V_2$ within the radial gap 35 and higher than the negative pressure Vi at the inlet 15 of the fan assembly 3. An additional advantage of the third sealing arrangement 43 is a better control of the location of direction of the second leakage flow 32 upon entering the main air flow 30 through the heat exchanger system 1, such that flow distortions can be further reduced.

Figure 5:
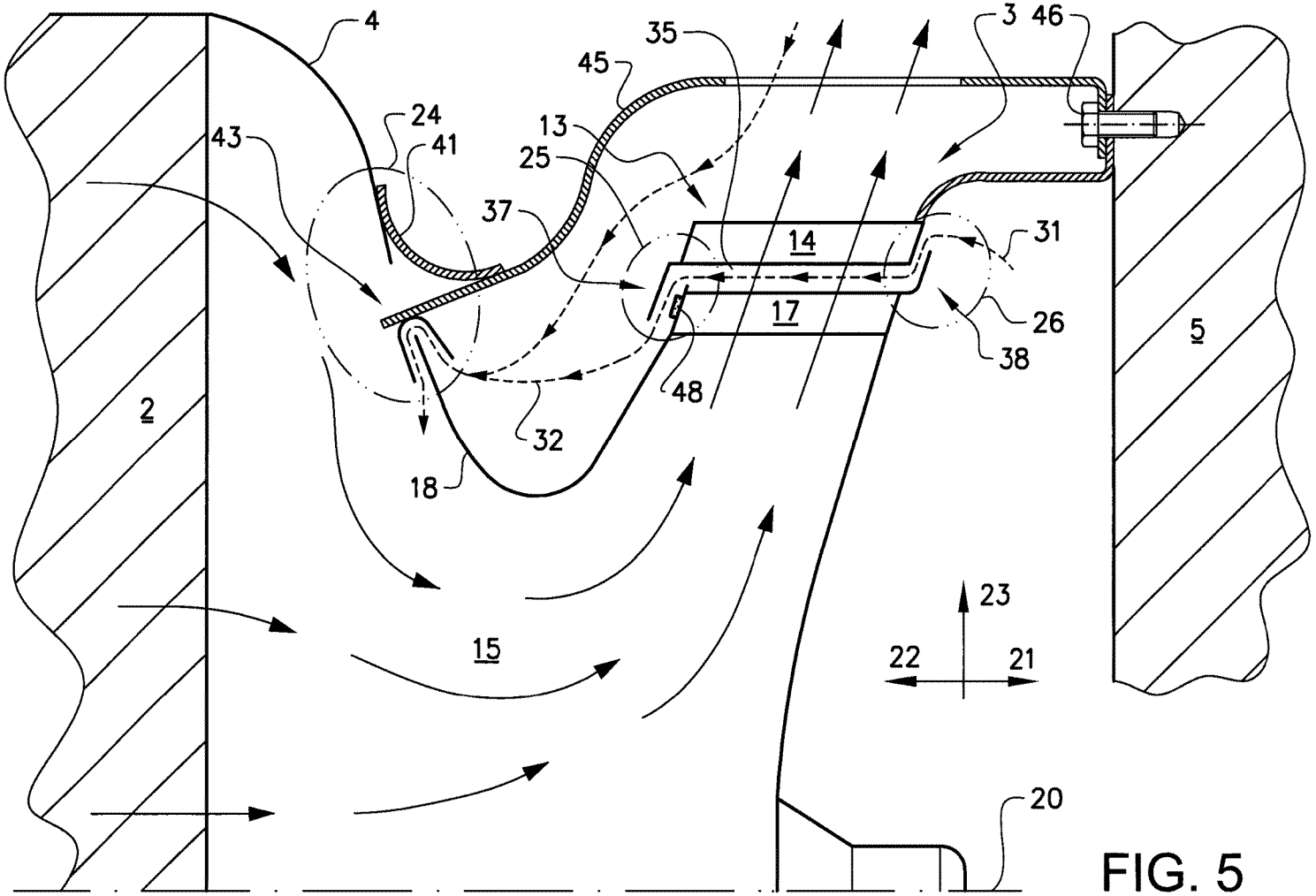
FIG. 5 shows a cross-sectional view of the heat exchanger system according to a fifth embodiment.

A fifth embodiment of the disclosure is shown in FIG. 5. This design differs from the design of FIG. 4 mainly in terms of the member contacting the elastic seal 41. In FIG. 4 the elastic seal 41 contacts the stationary inlet shroud 4 and part of the third labyrinth-type sealing arrangement 43. However, as already mentioned, the elastic seal 41 may contact any member mounted to the propulsion source 5, and as an alternative to contacting part of the third labyrinth-type sealing arrangement 43 the elastic seal 41 is arranged to contact a support member 45 mounted to the propulsion source 5 rearwards of the stator 43. The support member 45 is formed of a metal or plastic panel that may be mounted to the propulsion source 5 using the same mounting means 46 as the stator 13. Obviously, the elastic seal 41 may alternatively be contacting a member of a third sealing arrangement 43 that is fastened to the support member 45. The gap has increased leakage due to the lack of sealing capacity between the stator 13 and the third sealing arrangement 43, such that more air, and air having less negative pressure than the air of the radial gap 35, has access to the third sealing arrangement 43. Moreover, the stability of the support member 45 in the area of the third sealing arrangement 43 may be lower compared with using a stator shroud 44. Using a stator shroud design, as shown in FIG. 4, is thus in most circumstances advantageous in terms of sealing and cooling efficiency.

Figure 6A:
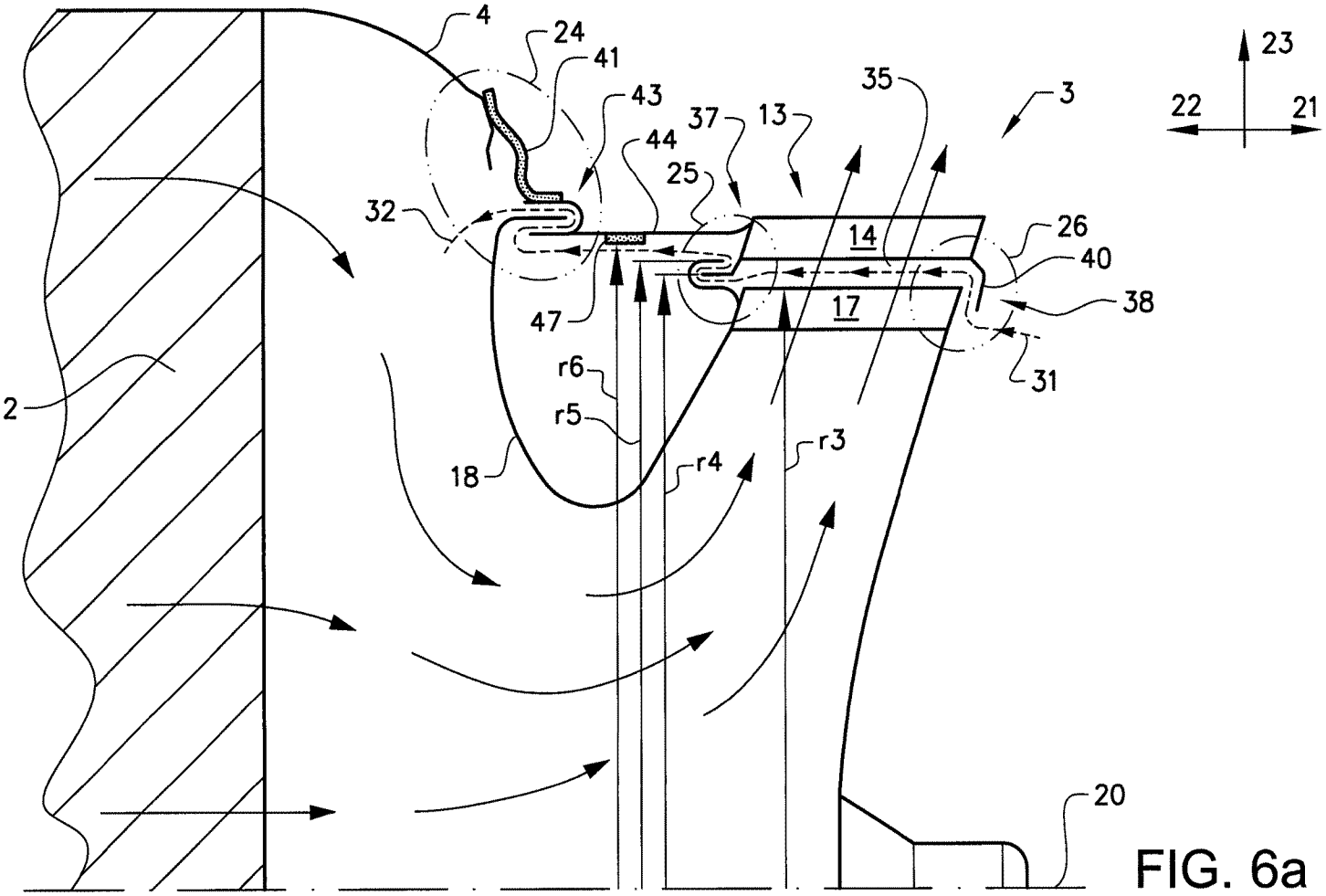
FIG. 6*a* shows a cross-sectional view of the heat exchanger system according to a sixth embodiment.

A sixth embodiment is disclosed in FIG. 6*a*. The sixth embodiment is functionally very similar to the fifth embodiment in terms of sealing performance and fan efficiency and comprises an elastic seal 41 at the first leakage area 24, first and second labyrinth-type sealing arrangements 37, 38 at the second and third leakage areas 25, 26 respectively, and a third labyrinth-type sealing arrangement 43 arranged to seal the gap between the rotatable inlet shroud 18 and the annular stator shroud 44. The advantage of the sixth embodiment is the configuration of the first, second and third labyrinth-type sealing arrangements 37, 38, 43 which all enable axial mounting and/or dismounting of the stator 13 and impeller 16 without any modification of the labyrinth-type sealing arrangements 37, 38, 43. Axial relative displacement is the only required action for performing the assembly or disassembly. This advantage is realised by arranging each of the labyrinth-type sealing arrangements 37, 38, 43 to enable axial separation or mounting of the labyrinth-type sealing arrangement 37, 38, 43, and by locating the labyrinth-type sealing arrangements 37, 38, 43 increasingly radially spaced from the rotational axis 20 along the axial direction of the heat exchanger system, such that the labyrinth-type sealing arrangements 37, 38, 43 do not interfere with each other during axial displacement of the fan assembly 3. A further advantage of this design is enablement of reduced tolerances within the labyrinth-type sealing arrangements 43, 37, 38 because the fan assembly expands due to deformation more in the axial direction than the radial direction during operation of the fan assembly. Consequently, the tolerances of the labyrinth-type sealing arrangements 43, 37, 38 can be made smaller when arranged along the axial direction.

One such arrangement is shown in FIG. 6*a* where the fan assembly 3 can be dismounted by displacing the impeller in the forward direction and/or the stator in the rearward direction. Where the second labyrinth-type sealing arrangement 38 is of a simple type, such as comprising merely an annular projecting shield 40 that is located rearwards of the impeller 16 and axially covering the radial gap 35, then it is ensured that the projecting shield 40 extends radially inwards from the stator 13, such that the impeller 16 can be axially displaced towards the forward direction 22. An annular projecting shield 40 that axially covers the radial gap 35 generally force the leakage flow to exhibit at least one 90 degrees turn before entering the radial gap 35.

Where the labyrinth-type sealing arrangement is slightly more complex, such as comprising one U-shaped section of a first part of the seal cooperating with an l-shaped projection of a second part of the seal, where the 1-shaped section is located partly within the U-shaped section, then the U-shaped section must be open in an axial direction. In FIG. 6*a* the first labyrinth-type sealing arrangement 37 exhibits a U-shaped section that is located on the impeller 16 and is open in a rearward direction 21, such that the impeller 16 can be axially displaced towards the forward direction 22

Similarly, also the third labyrinth-type sealing arrangement 43 comprises a U-shaped section of a first part of the seal cooperating with an I-shaped projection of a second part of the seal, where the I-shaped section is located partly within the U-shaped section. Also this U-shaped section must be open axially in a rearward direction 21 when located on the stator shroud 44, such that the impeller 16 can be axially displaced in the forward direction 22. Furthermore, a maximal radial extension $r_3$ of the impeller blades 17 and impeller side of the second labyrinth-type sealing arrangement 38 must be smaller than the minimum radial extension $r_4$ of the stator side of the first labyrinth-type sealing arrangement 37, and a maximal radial extension $r_5$ of the impeller side of the first labyrinth-type sealing arrangement 37 must be smaller than the minimum radial extension $r_6$ of the stator shroud 44 and stator side of the third labyrinth-type sealing arrangement 43. Thereby, the impeller 16 and stator 13 can be assembled and disassembled simply by axial relative displacement.

The elastic seal 41 is in this embodiment arranged to contact the stationary inlet shroud 4 and the stator side of the third labyrinth-type sealing arrangement 43. Obviously, the elastic seal 41 could alternatively be contacting any other part of the stator 13 or stator shroud 44 with any effect on the sealing efficiency of the fan assembly 3.

Figure 6B:
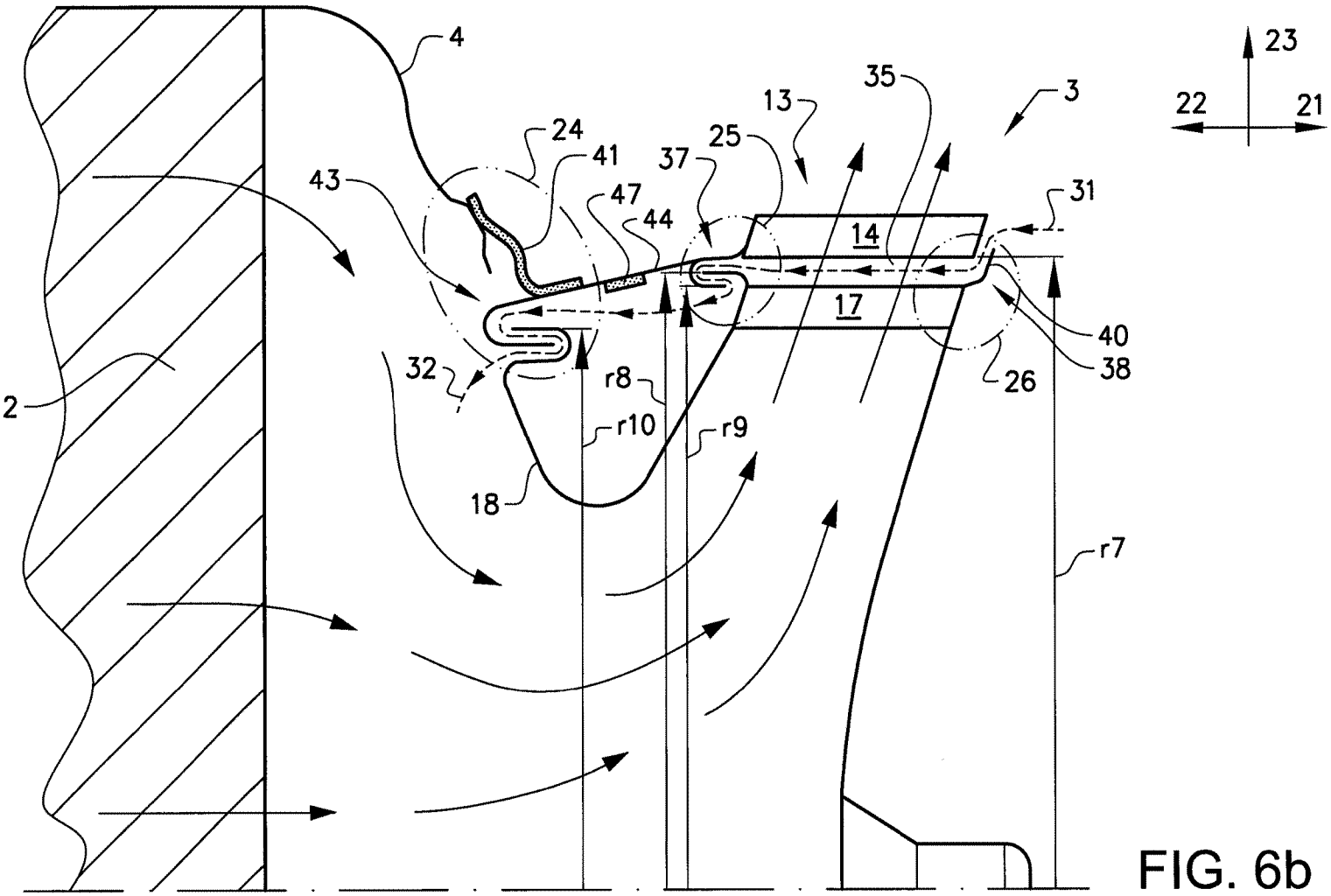
FIG. 6*b* shows a cross-sectional view of the heat exchanger system according to a seventh embodiment.

A seventh embodiment is disclosed in FIG. 6*b*. The functionality of the seventh embodiment is identical to the sixth embodiment and varies essentially only on the direction of axial mounting and/or dismounting of the impeller 16 and stator 13. In the heat exchanger system 1 of FIG. 6*b* the fan assembly 3 can be dismounted by moving the impeller 16 in the rearward direction 21 and/or the stator 13 in the forward direction 22. The second labyrinth-type sealing arrangement 38 comprises a projecting shield 40 extending radially outwards from the impeller 16, such that the impeller 16 can be axially displaced in the rearward direction 21. The annular projecting shield 40 axially covers the radial gap 35 and generally forces the leakage flow to exhibit at least one 90 degrees turn before entering the radial gap 35. The first labyrinth-type sealing arrangement 37 exhibits a U-shaped section that is located on the stator 13 and being open in a rearward direction 21, such that the impeller 16 can be axially displaced in the rearward direction 21. The U-shaped section of the third labyrinth-type sealing arrangement 43 is located on the stator shroud 44 and must be open axially in a rearward direction 21, such that the impeller 16 can be axially displaced in the rearward direction 21. Furthermore, a minimum radial extension $r_7$ of the stator blades 14 and stator side of the second labyrinth-type sealing arrangement 38 must be larger than the maximal radial extension $r_8$ of the impeller side of the first labyrinth-type sealing arrangement 37, and a minimal radial extension rg of the stator side of the first labyrinth-type sealing arrangement 37 must be larger than the maximum radial extension $r–i_0$ of the rotatable inlet shroud 18. Thereby, the impeller 16 and stator 13 can be disassembled simply by axial relative displacement.

The elastic seal 41 is in the seventh embodiment arranged to contact the stationary inlet shroud 4 and stator shroud 44. Obviously, the elastic seal 41 could alternatively be contacting any other part of the stator 13 or stator side of the third labyrinth-type sealing arrangement 43 without any effect on the sealing efficiency of the fan assembly 3.

Clearly, large variations of the first, second and third labyrinth-type sealing arrangements 37, 38, 43 are possible in terms of design and complexity. Also, use of other types of non-contact type sealing arrangements is possible, as well as a large number of different contact type sealing arrangements. For example, a brush seal is an air-to-air seal that provides an alternative to labyrinth-type seals. The brush seal typically comprises many densely packed wire filaments fused between two metallic plates. Brush seals offer many advantages when compared with traditional seals. Unlike the labyrinth seal, a brush seal is designed as a contact seal, i.e. to come in contact with the other part to provide a positive seal. The flexibility of the wires enables the seal to automatically adjust to accommodate vibrations without being permanently damaged A typical value for the minimum distance between stationary inlet shroud 4 and fan assembly 3 is 25 millimeters for avoiding any contact therebetween. A typical value for the minimum distance between impeller blades 17 and stator blades 14 is about 6 millimeters for reducing leakage in and out of the gap 35, as well as increasing fan efficiency. The size of the blades depends on the specific application, and may typically for large engines have an axial length of about 100 millimeters.

The stator 13 may be formed in at least two parts that can be assembled into a single stator 13. The multipart stator 13 is preferably divided in an axial plane into at least two parts for enabling mounting on the impeller 16.

The radial gap 35 between impeller blades 17 and stator blades 14 is defined by the minimum distance between the impeller blades 17 and stator blades 14 in a direction essentially perpendicular the direction of elongation of the blades 14, 17. Consequently, if the blades are inclined with respect to the axial direction then the gap is also measured in said inclined direction.

The term "elastic" in elastic seal means that the seal has the capacity to deform to a certain extent without any reduction in terms of sealing performance. The elasticity of the elastic seal may be provided by the material characteristics, such as a rubber material or certain more elastic plastic materials, and/or by means of structural characteristics of the seal, such as bellows or corrugations that provides the elasticity of the seal, without the material itself being elastic.

The term semi-radially refers to a direction between a pure radial direction and a pure axial direction, i.e. an angle above 0 degrees and below 90 degrees with respect to an axial direction. Stator blades being located semi-radially outside the impeller may thus for example be located rearwardly inclined outside of the impeller, resembling a mixed flow fan.

Reference signs mentioned in the claims should not be seen as limiting the extent of the matter protected by the claims, and their sole function is to make claims easier to understand.

As will be realised, the disclosure is capable of modification in various obvious respects, all without departing from the scope of the appended claims. Each of the examples of the disclosure of FIGS. 1-6*b* exhibit a certain type and design of the labyrinth-type sealing arrangements, but the illustrated figures and layouts not restrictive and many various designs of the sealing arrangement are possible. One, two or all of the leakage locations 24-26 may also lack a sealing arrangement as shown in FIG. 2. Accordingly, the drawings and the description thereto are to be regarded as illustrative in nature, and not restrictive.

The invention claimed is:

1. Heat exchanger system for a vehicle, the heat exchanger system comprising: at least one heat exchanger; a centrifugal fan assembly for improving the flow of air through the at least one heat exchanger, the fan assembly comprising a rotatably mounted impeller with a plurality of impeller blades, and a rotatable inlet shroud for guiding the air flow entering the impeller: and a stationary inlet shroud located between the at least one heat exchanger and the fan assembly and configured for directing air flow exiting the at least one heat exchanger towards the rotatable inlet shroud of the fan assembly, wherein the fan assembly further comprising a stator with a plurality of stationary stator blades located radially or semi-radially outside the impeller for conversion of fluid dynamic pressure to fluid static pressure of the air flow, wherein an elastic seal is arranged between the stationary inlet shroud and a member fastened to the stator for sealing the gap between the stationary inlet shroud and fan assembly, the elastic seal is fastened to at least one of the stationary inlet shroud or the member fastened to the stator.

2. Heat exchanger system according to claim 1, wherein the elastic seal is fastened to at least one of the stationary inlet shroud and a member mounted to a propulsion source of the vehicle.

3. Heat exchanger system according to claim 1, wherein the elastic seal is fastened to one of (a) the stationary inlet shroud and, (b) a support member mounted to a propulsion source rearwards of the stator, and (c) a member fastened to the support member.

4. Heat exchanger system according to claim 1, wherein the elastic seal comprises an elastic sealing sleeve.

5. Heat exchanger system according to claim 1, wherein a gap between the impeller blades and stator blades is sealed by at least one labyrinth-type sealing arrangement for preventing air leaking in or out of the gap.

6. Heat exchanger system according to claim 3, wherein the at least one labyrinth-type sealing arrangement is arranged to seal a gap between the rotatable inlet shroud and a member mounted to the propulsion source and seals a structure at least partially defining a fan assembly inlet.

7. Heat exchanger system according to claim 6, wherein the at, least one labyrinth-type sealing arrangement is arranged to seal a gap between the rotatable inlet shroud and a stator shroud that extends forwards from die stator.

8. Heat exchanger system according to claim 7, wherein the at least one labyrinth-type sealing arrangement of the heat exchanger system is configured for enabling axial mounting and/or dismounting of the stator and impeller.

9. Heat exchanger system according to claim 1, wherein flow straightening devices are provided for straightening any air flow leaking out from a gap between the impeller blades and stator blades and back into the inlet of the impeller.

10. Heat exchanger system according to claim 1, wherein sliding contact members made of rubber or plastic material are provided between the impeller and the stator, or any parts that are fastened or associated with the impeller and the stator, for preventing undesired noise and vibrations during occurrences of contact with each other.

11. Heat exchanger system according to claim 1, wherein the impeller further comprises a back plate for structurally connecting the rotatable blades with a rotatable shaft of the impeller.

12. Heat exchanger system according to claim 3, wherein both the impeller and the stator are mounted to the propulsion source.

13. Heat exchanger system according to claim 1, wherein the stationary inlet shroud is mounted to the at least one heat exchanger or a chassis of the vehicle.

14. Heat exchanger system according to claim 1, wherein the at least one heat exchanger is arranged such that air flow during use of the heat exchanger system is configured to flow through the at least one heat exchanger in a direction substantially coaxial with rotational axis of the impeller.

15. Heat exchanger system according to claim 7, wherein the stator shroud is integrally formed with stator.

16. Heat exchanger system according to claim 1, wherein the rotatable inlet shroud is integrally formed with the impeller.

17. Heat exchanger system according to claim 1, wherein the rotatable inlet shroud together with a side portion of the impeller comprises a U-shaped cross-section that is open towards the radial outside.

18. Vehicle comprising a heat exchanger system according to claim 1.

* * * * *